US006688953B2

(12) United States Patent
Kawasaki et al.

(10) Patent No.: US 6,688,953 B2
(45) Date of Patent: Feb. 10, 2004

(54) BARREL POLISHING APPARATUS

(75) Inventors: Shuji Kawasaki, 1431, Nakatajima-cho, Hamamatsu-shi, Shizuoka-ken, 430 (JP); Akitaka Matsushita, 665, Kanaori-cho, Hamamatsu-shi, Shizuoka-ken, 435 (JP)

(73) Assignees: Shuji Kawasaki, Shizuoka (JP); Akitaka Matsushita, Shizuoka (JP); BBF Yamate Corporation, Shizuoka (JP)

( * ) Notice: Subject to any disclaimer, the term of this patent is extended or adjusted under 35 U.S.C. 154(b) by 0 days.

(21) Appl. No.: 09/893,095

(22) Filed: Jun. 26, 2001

(65) Prior Publication Data

US 2002/0077047 A1 Jun. 20, 2002

Related U.S. Application Data

(63) Continuation-in-part of application No. 08/929,785, filed on Sep. 15, 1997, now abandoned.

(30) Foreign Application Priority Data

| | | |
|---|---|---|
| Nov. 27, 1996 | (JP) | 8-332865 |
| Nov. 27, 1996 | (JP) | 8-332866 |
| Dec. 31, 1996 | (JP) | 9-358014 |
| Dec. 31, 1996 | (JP) | 9-358015 |
| Feb. 14, 1997 | (JP) | 9-047369 |
| Feb. 14, 1997 | (JP) | 9-047370 |

(51) Int. Cl.[7] ..... B24B 31/00

(52) U.S. Cl. ..... 451/327; 451/326; 451/106; 451/113

(58) Field of Search ..... 451/32, 35, 326, 451/327, 328, 104, 106, 113

(56) References Cited

U.S. PATENT DOCUMENTS

| | | | | |
|---|---|---|---|---|
| 3,623,278 A | * | 11/1971 | Schwartz | |
| 5,449,313 A | * | 9/1995 | Kordonsky et al. | 451/35 |
| 6,280,303 B1 | * | 8/2001 | Kawasaki | 451/104 |

* cited by examiner

*Primary Examiner*—Eileen P. Morgan
(74) *Attorney, Agent, or Firm*—Muramatsu & Associates

(57) ABSTRACT

A barrel polishing apparatus which can easily hold a work having a large mass and detach therefrom. The barrel polishing apparatus includes a polishing medium receiving container having a polishing medium received therein and a work supporting arm for holding the work. The position of the work supporting arm is shifted from the center of the polishing medium receiving container. The polishing medium receiving container rotates about a vertical axis to form a continuous circumferential flow of polishing medium therein and includes an upper end opening for receiving the work attached to a distal end of the work supporting arm. The work supporting arm is oriented diagonally toward a direction of the continuous circumferential flow of polishing medium.

1 Claim, 8 Drawing Sheets

BARREL POLISHING APPARATUS

This is a continuation-in-part of U.S. patent application Ser. No. 08/929,785 filed on Sep. 15, 1997, now abandoned.

BACKGROUND OF THE INVENTION

1. Field of the Invention

This invention relates to a barrel polishing apparatus for polishing a surface of a work by relative movements of polishing medium.

2. Description of the Related Art

One of the methods of polishing a surface of a work (workpiece) is to rotate or vibrate polishing medium or abrasive in a container and the work is introduced in the container. With use of such a conventional barrel polishing apparatus, each work is subjected to polishing by allowing a polishing medium to flow in a polishing medium receiving container while the work is dipped in the polishing medium in the polishing medium receiving container.

In using the conventional barrel polishing apparatus, however, since each workpiece is dipped in the polishing medium in the polishing medium receiving container while it is seized immovably, there arises an inconvenience that it is difficult to polish the workpiece in a short time.

SUMMARY OF THE INVENTION

The present invention has been made in order to eliminate the inconvenience inherent to the conventional technique as mentioned above.

Therefore, it is an object of the present invention is to provide a barrel polishing apparatus which substantially improves an operational efficiency in a process of polishing the work.

According to the present invention, the barrel polishing apparatus includes a polishing medium receiving container having a polishing medium therein and a work supporting arm, the polishing medium receiving container includes an upper end opening, the work supporting arm is able to rotate about a longitudinal axis thereof, and a work is detachably attached to an end of the work supporting arm. As the work and the polishing medium sufficiently and easily contact each other, an operational efficiency of the barrel polishing operation can be substantially improved.

In addition, since the barrel polishing apparatus is so structured that the work supporting arm can extend and contract in the longitudinal axial direction, each work can be dislocated to assume a low position when it is attached to the work supporting shaft and detached from the same. Thus, the work can more easily be attached to the work supporting shaft and detached from the same, resulting in the ease of operation in replacing the work.

In addition, since the barrel polishing apparatus is so structured that the work supporting arm is turnably displaced in the horizontal direction, the work can easily be located at an adequate position in the polishing medium receiving container.

Further, since the work supporting arm is turnably displaced in the horizontal direction, the work can be located under the condition that the surface of the work to be polished is upwardly inclined in the flowing direction of the polishing medium against the inner side wall and/or the bottom wall of the polishing medium receiving container. Thus, a flowing of the polishing medium can be throttled between the work and the inner side wall and/or the bottom wall of the polishing medium receiving container. Therefore, the pressure of the polishing medium to the surface to be polished of the work can be increased, resulting in substantial improvements in the polishing effect of the work.

DETAILED DESCRIPTION OF THE INVENTION

Figure 1:
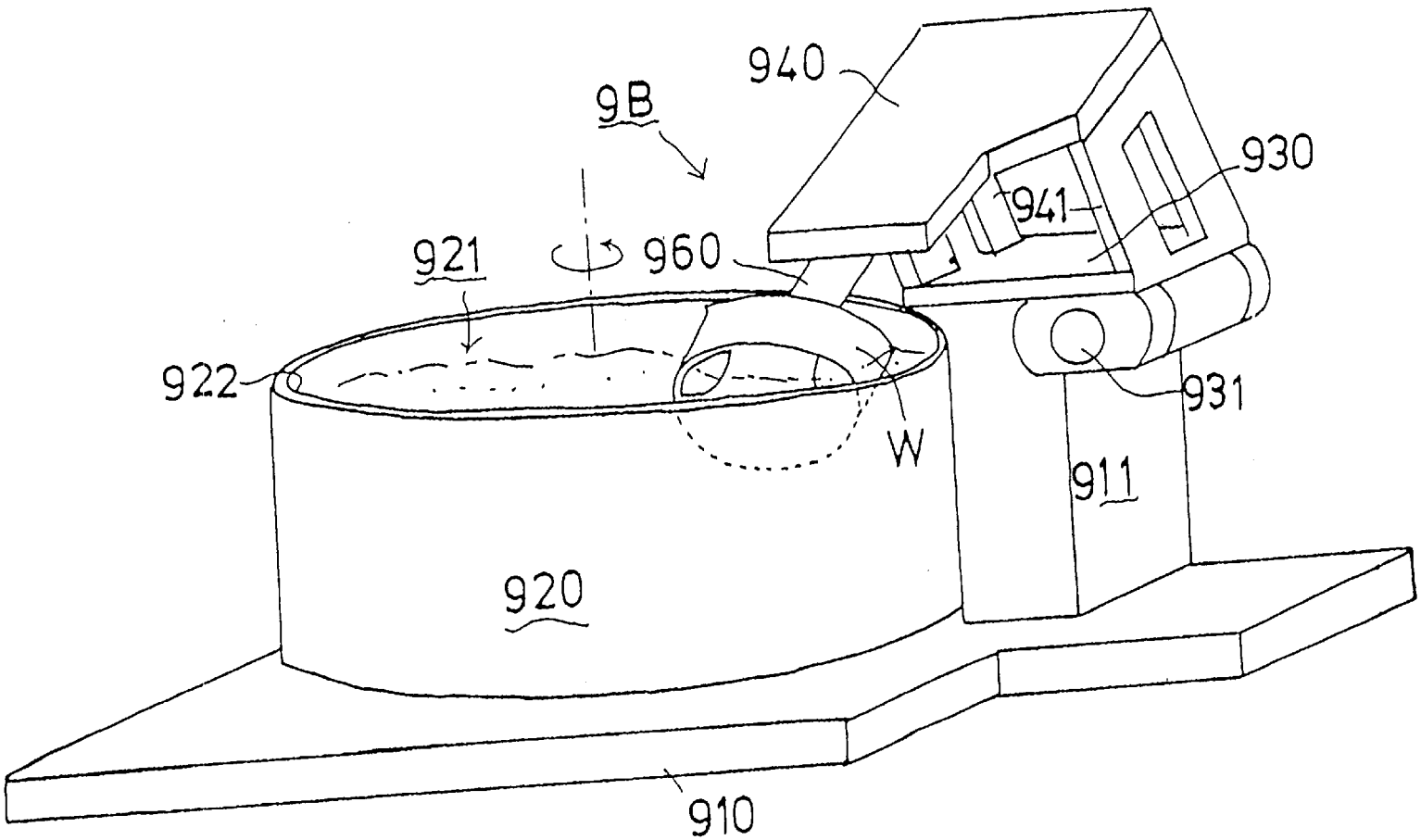
FIG. 1 is a perspective view showing a barrel polishing apparatus in the first embodiment of the present invention.
Figure 2:
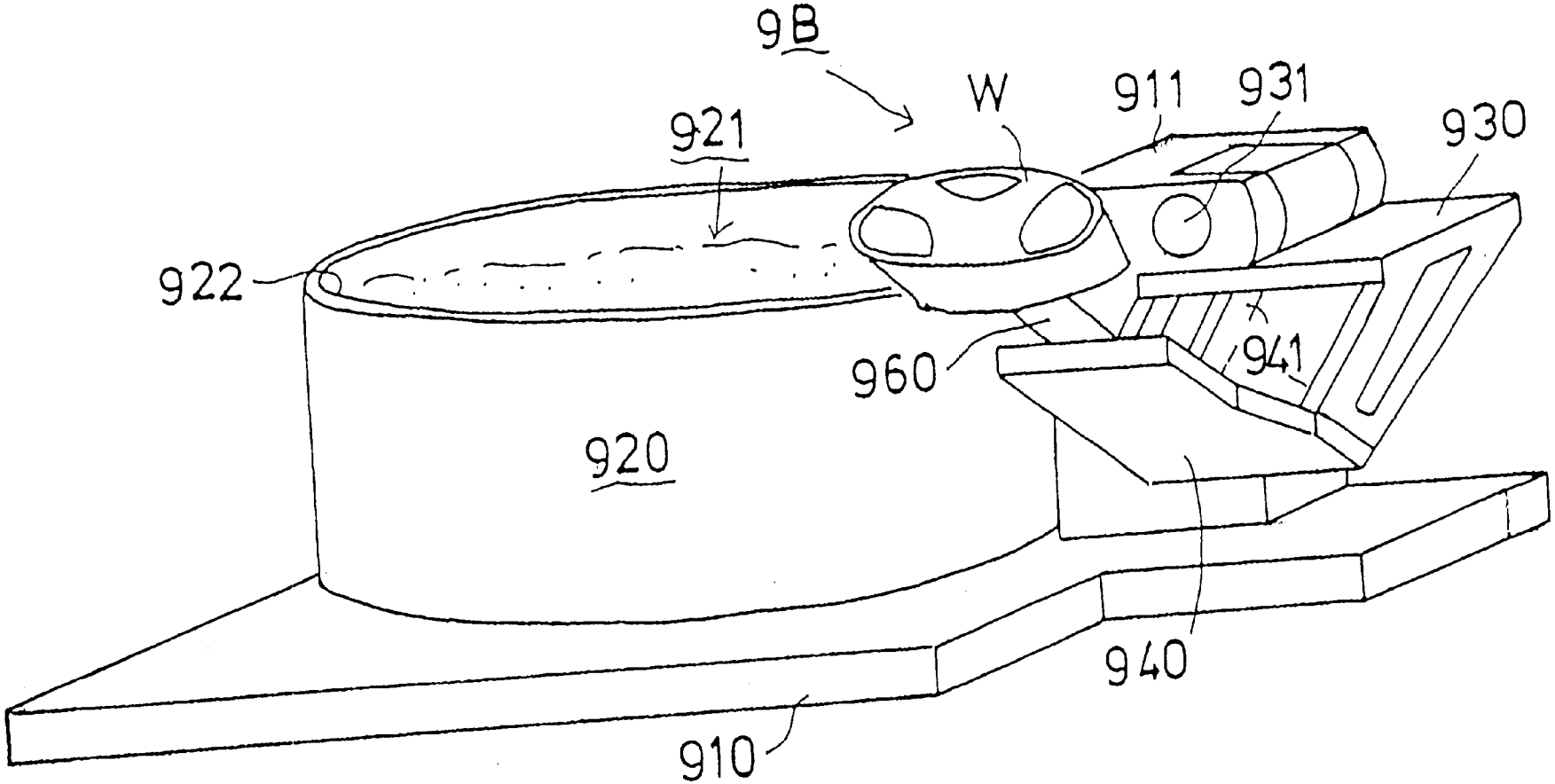
FIG. 2 is a perspective view showing an attached state and a detached state assumed by the barrel polishing apparatus shown in FIG. 1.
Figure 3:
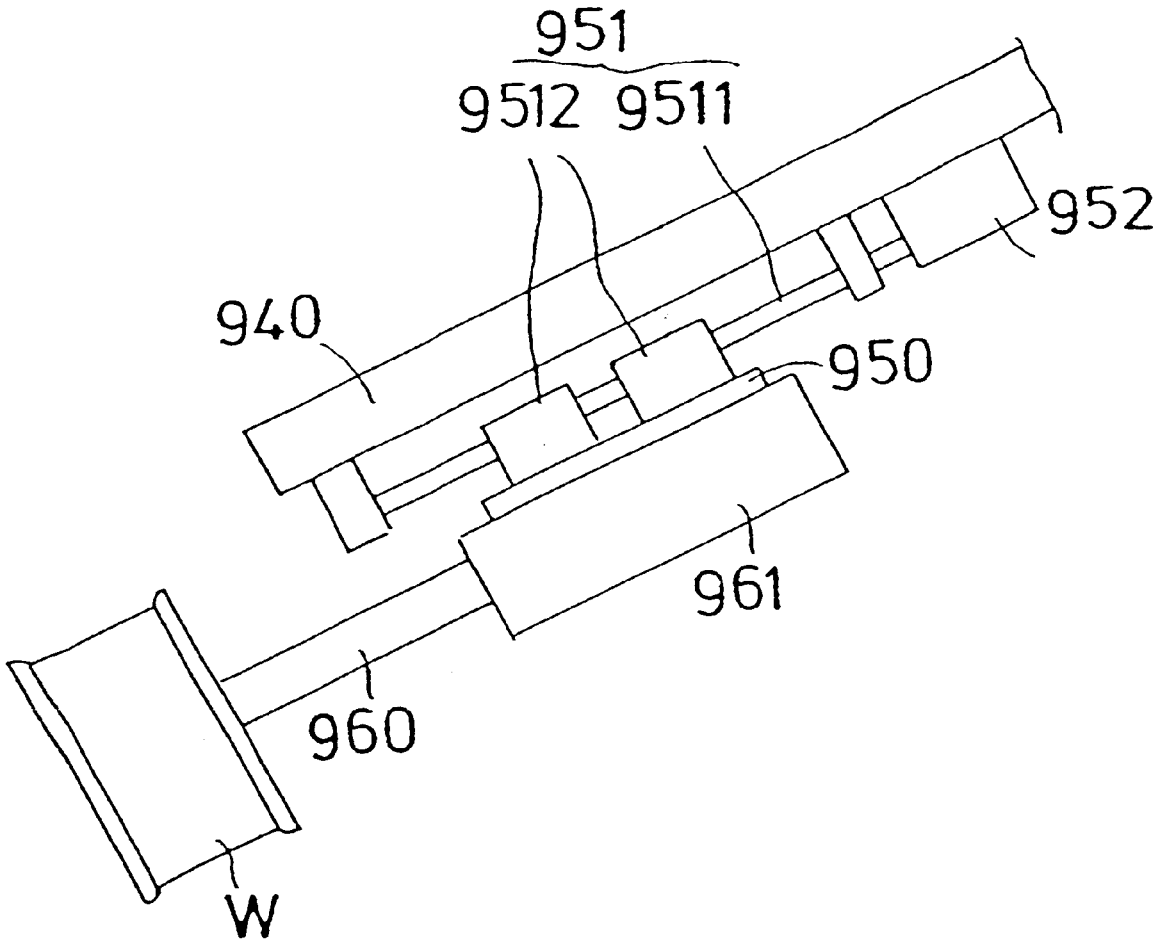
FIG. 3 is a schematic diagram showing a forward/rearward displacing mechanism employable for a work supporting arm arranged on the work supporting unit used in the barrel polishing apparatus of FIG. 1.
Figure 4:
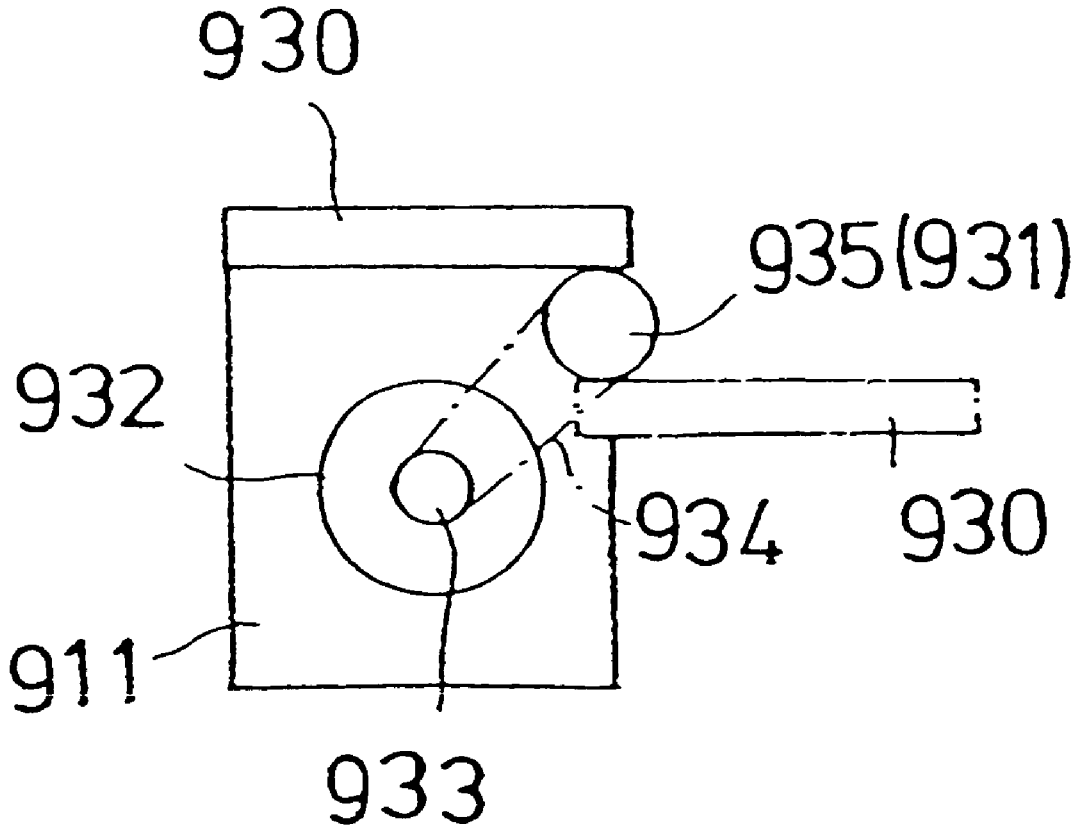
FIG. 4 is a schematic diagram showing a rotating mechanism employable for a reversing plate arranged on the work supporting unit used in the barrel polishing apparatus of FIG. 1.

FIG. 1 is a perspective view showing a barrel polishing apparatus constructed in accordance with the first embodiment of the present invention wherein a work is held in the polishing state. FIG. 2 is a perspective view showing the attached/detached state of the work in the barrel polishing apparatus. FIG. 3 is an illustrative view showing a forward/backward displacing mechanism for a work supporting arm in the barrel polishing apparatus. FIG. 4 is an illustrative view showing a rotating mechanism for a reversing plate in the barrel polishing apparatus.

In FIG. 1 and FIG. 2, reference numeral 9B designates a barrel polishing apparatus, and reference numeral 910 designates a base board for the barrel polishing apparatus 9B. Reference numeral 920 designates a polishing medium receiving container mounted on the base board 910. The polishing medium receiving container 920 has a cylindrical configuration so that it can be rotated about an axis line thereof (FIG. 1) in the circumferential direction by actuating suitable driving means (not shown). Reference numeral 921 designates a polishing medium in the polishing medium receiving container 920. All kinds of normally available material such as ceramic grain or the like can be used as the polishing medium 921. Incidentally, a wet type polishing process may be used for practicing a polishing method, and alternatively, a dry polishing process may also be used for practicing the polishing method.

Reference numeral 922 designates an upper end opening which is formed at the upper end of the polishing medium receiving container 920, and a work W (for example, an aluminum wheel usable for vehicle or the like) to be described later is dipped in the polishing medium 921 via the upper end opening 922.

Next, reference numeral 911 designates a supporting frame formed on the base board 910. The supporting frame 911 is caused to extend in the upward direction to reach the substantially upper end of the polishing medium receiving container 920.

Reference numeral 930 designates a reversing plate which is turnably mounted on the supporting frame 911 via a rotational shaft 931. The reversing plate 930 can be turned within the range of about 180° by rotation of the rotational shaft 931 (i.e. within the range defined by the state shown in FIG. 1 and the state shown in FIG. 2). In addition, as shown in FIG. 4, a first driving motor 932 is mounted on the supporting frame 911. While the rotational force of the first driving motor 932 is reduced in the decelerated state, the foregoing rotational force is transmitted from a pulley 933 of the first driving motor 932 to a pulley 935 of the rotational shaft 931 via a V-belt 934, whereby the reversing plate 930 is turned within the range of about 180° as noted above.

Reference numeral 940 designates a supporting bed fixed to the reversing plate 930 via a pair of brackets 941. The supporting plate 940 is mounted on the supporting frame 911 in the forwardly inclined state (it is assumed that a distal end side of a work supporting arm 960 to be described later is represented as a forward direction). It should be noted that the inclination angle of the supporting bed 940 can be adjusted.

Next, a slide plate 950 (FIG. 3) is arranged on the back surface of the supporting bed 940 so as to move in the forward or backward direction along the inclined surface of the supporting plate 940. The slide plate 950 can be displaced relative to the supporting bed 940 in the forward/backward direction by actuating, for example, a bolt/nut mechanism 951. Incidentally, reference numeral 9511 designates a bolt portion in the bolt/nut mechanism 951 arranged on the back surface of the supporting bed 940, and reference numeral 9512 designates a pair of nut portions connected to the slide plate 950. When a second driving motor 952 is driven, causing the bolt portion 9511 to be rotated, the nut portions 9512, i.e., the slide plate 950 are displaced in the forward/backward direction by way of threadable engagement of the bolt portion 9511 with the nut portions 9512.

Referring to FIG. 1 and FIG. 2 again, reference numeral 960 designates a work supporting arm, and as shown in FIG. 3, the work supporting arm 960 is projected from the slide plate 950. A work W (for example, an aluminum wheel usable for vehicle or the like) is detachably attached to the foremost (distal) end of the work supporting arm 960 with the aid of an air chuck (not shown) so that the work W is dipped in the polishing medium 921 in the polishing medium receiving container 920. In addition, as shown in FIG. 3, a third driving motor 961 is mounted on the slide plate 950. The work supporting arm 960 can be rotated about a longitudinal axis line thereof by transmitting the rotational force of the third driving motor 961 to the work supporting arm 960 in the decelerated state. Incidentally, the work supporting arm 960 can intermittently be rotated in the normal direction as well as in the reverse direction.

An operation of the polishing apparatus will be described below.

Firstly, as shown in FIG. 2, the reversing plate 930 is arranged outside of the polishing medium receiving container 920 by driving the first driving motor 932, causing the rotational shaft 931 to rotate (refer to the state as represented by phantom lines in FIG. 4). At this time, the foremost (distal) end of the work supporting arm 960 assumes an upwardly inclined state. While this state is maintained, an operator attaches the work W on the foremost end of the supporting arm 960.

Thereafter, as shown in FIG. 1, the reversing plate 930 is located inside of the polishing medium receiving container 920 by driving the first driving motor 932, causing the rotational shaft 931 to be rotated, whereby the wheel (work) W is dipped in the polishing medium 921 in the polishing medium receiving container 920 in the flowing state. Incidentally, while the wheel W is contacting the polishing medium 921 in the dipped state, the work supporting arm 960 can intermittently be displaced in the vibrative state. After completion of the polishing operation, the reversing plate 930 is located outside of the polishing medium receiving container 920 by driving the first driving motor 932, causing the rotational shaft 931 to be rotated. At this time, the fore end part of the work supporting arm 960 assumes an upwardly inclined state. While this state is maintained, the operator disconnects the wheel (work) W from the work supporting arm 960, and thereafter, attaches a next work on the work supporting shaft 960.

Incidentally, when soft material such as sponge, rubber, soft plastic or the like is used in the polishing apparatus 9B as the polishing medium, each finish polishing operation can be achieved at a high efficiency. Further, soft material may be coated on the surface with hard grain or hard small block. The coated hard grain or the coated hard small block can be used as the polishing medium of the aforementioned type. As known in the art, after the barrel polishing operation is completed, surface treatment such as coating, plating, alumite treatment or the like is carried out for the work. All kinds of usually available surface treatment are included within the concept of surface treatment.

Figure 5:
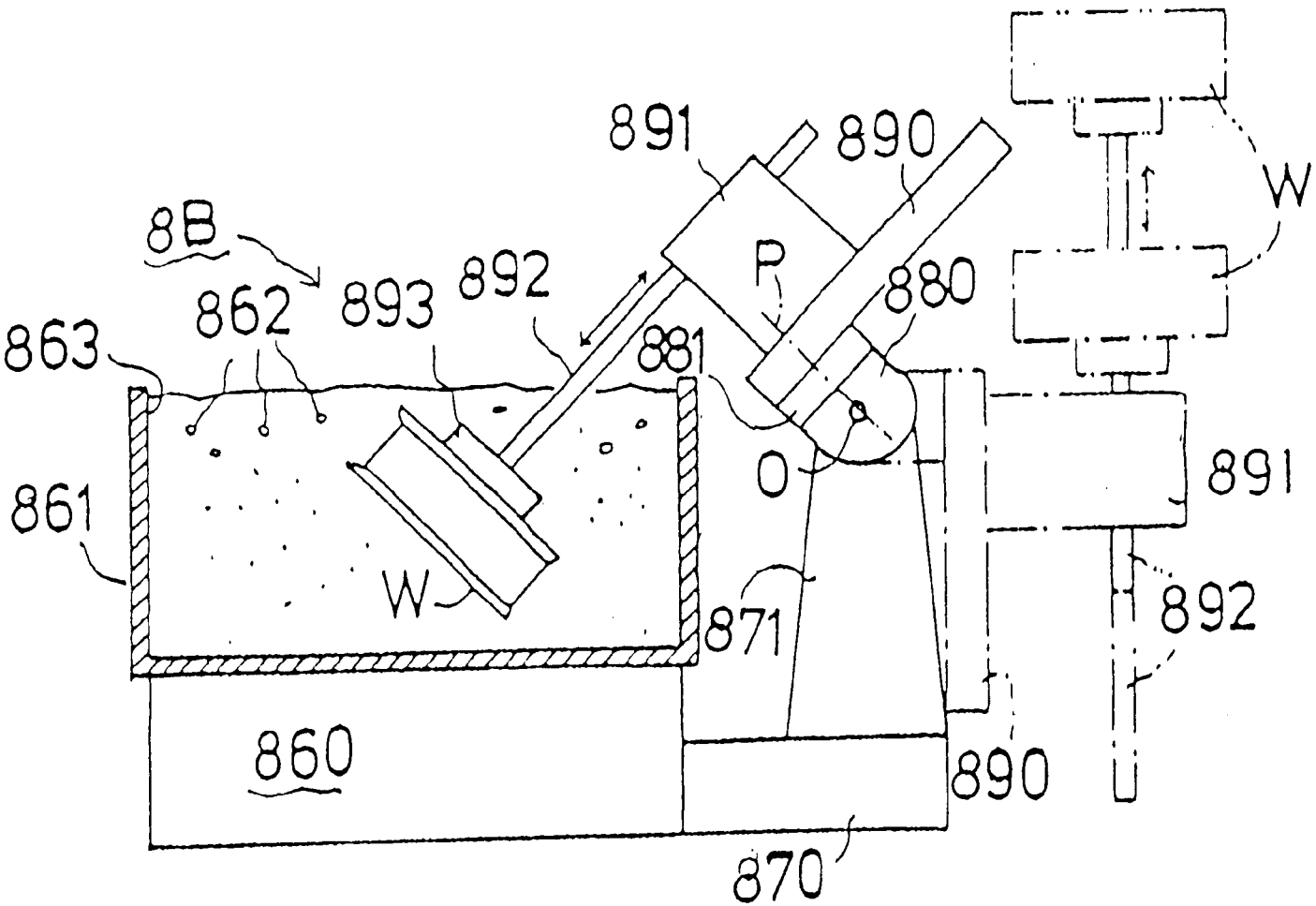
FIG. 5 is a sectional view showing a barrel polishing apparatus in the second embodiment of the present invention.

FIG. 5 shows a barrel polishing apparatus which is a second embodiment of the present invention. In FIG. 5, reference numeral 8B designates a barrel polishing apparatus, and reference numeral 860 designates a driving section for driving the barrel polishing apparatus 8B such as by a rotational force of a motor (not shown). Reference numeral 861 designates a cylindrical polishing medium receiving container mounted on the driving section 860. The polishing medium receiving container 861 can be rotated about an axis line of the driving section 860 in the circumferential direction by actuating the driving section 860. Reference numeral 862 designates a polishing medium in the polishing medium receiving container 861. All kinds of usually available polishing medium such as ceramic grain or the like can be employed for the polishing medium 862. In addition, a wet type polishing process may be employed for the polishing method, and alternatively, a dry type polishing process may be employed for the polishing method.

Reference numeral 863 designates an upper end opening which is formed at the upper end of the polishing medium receiving container, and a work W (for example, an aluminum wheel usable for vehicle or the like) to be described later is dipped in the polishing medium 862 via the upper end opening 863.

Next, reference numeral 870 designates a base board which is integrated with the driving section 860, and reference numeral 871 designates a supporting column which upright stands on the base board 870. The supporting column 871 extends in the upward direction to reach the substantially upper end of the polishing medium receiving container 861.

Reference numeral 880 designates an attaching bracket which is arranged to swing on the supporting column 871. Specifically, the attaching bracket 880 can swing about a point O along the vertical surface. Reference numeral 890 designates a supporting bed mounted on the attaching bracket 880 via rotating means 881. With this construction, the supporting bed 890 can swing along the vertical surface together with the attaching bracket 880, and moreover, it can turn or swing about an axis line P by driving the rotating means 881.

Reference numeral 891 designates a supporting member which is arranged on the supporting bed 890 in such a manner as to enable it to move in the forward/backward direction. In addition, reference numeral 892 designates a supporting arm which is fitted into the supporting member 891 in such a manner as to enable it to move in the forward/backward (longitudinal) direction. Reference character W designates a work (for example, an aluminum wheel usable for vehicle or the like). The work W is attached to the foremost end of the supporting arm 892 via an air chuck 893 so as to be dipped in the polishing medium 862 in the polishing medium receiving container 861.

An operation of the polishing apparatus constructed in the aforementioned manner will be described below.

Firstly, as shown by phantom lines (one-dot chain lines) of FIG. 5, the supporting arm 892 is in the position where its upper end is located directly above the supporting member 891, and thereafter, it is retracted in the downward direction. While the foregoing state is maintained, the wheel (work) W is fixedly mounted on the upper end of the supporting arm 892 with the aid of the air chuck 893. Thereafter, as shown by phantom lines (two-dot chain lines), the supporting arm 892 is extended in the upward direction. Then, as shown by solid lines, the supporting arm 892 is rotated about the point O together with the supporting member 892 and the supporting bed 890 along the vertical surface, whereby the wheel W is dipped in the polishing medium 852 which is flowing in the polishing medium receiving container 861.

Incidentally, while the wheel W is dipped in the polishing medium 862, the supporting arm 892 can periodically be displaced in the vibrative state. After completion of the polishing operation, the supporting arm 892 is rotated about the point O in the opposite direction together with the supporting bed 890 along the vertical surface, and then, as shown by the phantom lines (two-dot chain lines), the supporting arm 892 is held at the position where the foremost end of the supporting arm 892 is located directly above the supporting member 891. Thereafter, the supporting arm 892 is retracted in the downward direction as shown by the phantom lines (one-dot chain lines). While the foregoing state is maintained, the wheel W is disconnected from the foremost end of the supporting arm 892. Subsequently, the aforementioned operational steps are repeated.

Incidentally, when soft material such as sponge, rubber, soft plastic or the like is used as a polishing medium employable for the polishing apparatus 82, each finish polishing operation can be achieved at a high efficiency. Incidentally, soft material may be coated on the surface with hard grain or hard small block so as to allow the coated hard grain or the coated hard small block to be used as a polishing medium of the aforementioned type.

After completion of the barrel polishing operation, as is known in the art, surface treatment such as coating, plating, alumite treatment or the like is conducted. All kinds of normally available material is employable for achieving the surface treatment.

For example, an aluminum wheel usable for a vehicle or the like can be noted as a work employable for carrying out the present invention. However, the present invention should not be limited only to the aluminum wheel as a work but all products each usable as a work are included within the concept of the work in the present invention.

Usually, a wet type polishing method or a dry type polishing method for polishing the polishing surface of a work in the presence of a polishing agent is employed as a polishing method in the present invention. In this case, the number of buffs usable for carrying out the present invention may be limited only to one. Alternatively, a plurality of buffs may be used for carrying out the present invention. Incidentally, a buff wheel can be noted as one example which represents the buff.

To carry out the present embodiment, an ordinary wet type polishing method and an ordinary dry type polishing method can be employed for practicing the wet type polishing method and the dry type polishing method wherein the surface of a work is subjected to polishing in the presence of a polishing agent fed between the polishing surface of the work and the working surface of the buff wheel.

In addition, to carry out the present invention, any type of barrel polishing method such as a fluid barrel polishing method, a vibration barrel polishing method or the like can be used as a barrel polishing method. Additionally, any type of usually used polishing agent such as ceramic grain or the like can be employed as a polishing agent.

Further, the barrel polishing operation performed as a preliminary step for the dry type polishing step can be used as a so-called rough polishing operation.

Furthermore, the barrel polishing operation performed as a preliminary step for the wet type polishing operation exhibits the same operational effect as that of the dry type polishing operation, and therefore, it can be used as a so-called intermediate polishing step.

Moreover, the barrel polishing operation performed as a post-step for the wet type polishing operation exhibits the same operational effect as that of the wet type polishing operation, and therefore, it can be used as a so-called finish polishing step.

Figure 6:
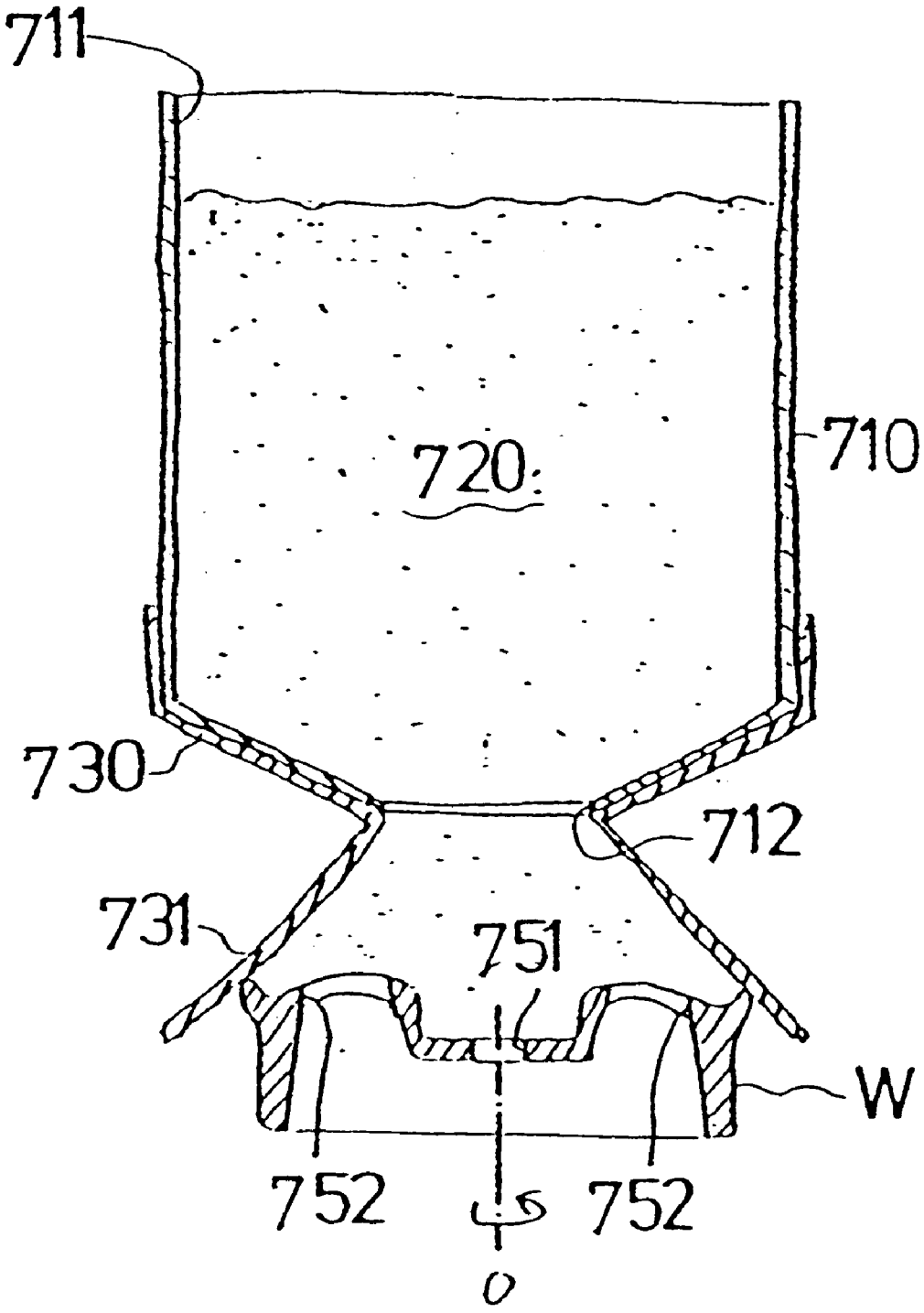
FIG. 6 is a sectional view showing a barrel polishing apparatus in the third embodiment of the present invention.

FIG. 6 shows a barrel polishing apparatus constructed, in accordance with the third embodiment of the present invention.

In FIG. 6, reference numeral 710 designates a polishing medium receiving container for a barrel polishing apparatus. A polishing medium (aggregate) 720 is received in the polishing medium receiving container 710. Incidentally, any kind of usually used polishing medium such as ceramic grain or the like can be employed for the polishing medium 720.

Reference numeral 711 designates an upper end opening formed at the upper end of the polishing medium receiving container 710, and the interior of the polishing medium receiving container 710 is communicated with the atmosphere via the upper end opening 711.

Reference numeral 712 designates a polishing medium feeding port formed at the bottom part of the polishing medium receiving container 710.

A polishing medium 720 contained in the polishing medium receiving container 710 naturally falls down via the polishing medium feeding port 712. The intensity of pressure generated by the falling down of the polishing medium 720 is gradually reduced as the amount of the polishing medium 720 remained in the polishing medium receiving container 710 is decreased.

Reference numeral 730 designates a guide sleeve which is fitted to the bottom part of the polishing medium receiving container 710 in such a manner as to enable the guide sleeve 730 to be rotated. In addition, reference numeral 731 designates a trumpet-like sleeve which constitutes a part of the guide sleeve 730 arranged at the lower part of the guide sleeve 730. A function of the guide sleeve 730 will be described later.

Reference character W designates an aluminum wheel usable for a vehicle or the like (corresponding to a "work" in the present invention). This wheel W can be rotated around an axis line 0 while it is vibrated. Incidentally, when the wheel W is rotated, the guide sleeve 730 inclusive of the trumpet-like sleeve 731 is vibratively rotated.

When the polishing medium 720 naturally falls down from the polishing medium receiving container 710 toward the surface of the wheel W while the wheel W is vibratively rotated, the polishing medium 720 continuously reaches the surface of the wheel W via the guide sleeve 730 with any substantial gap between the polishing medium receiving container 710 and the guide sleeve 730. The polishing medium 720 is discharged in the downward direction via a plurality of holes 751 and 752 of the wheel W.

Incidentally, as mentioned above, the intensity of feeding pressure generated by the polishing medium 720 to be fed to the wheel W is reduced as the amount of the polishing medium 720 remained in the polishing medium receiving container 710 is decreased. Thus, even though a single kind of polishing medium 720 is employed, the surface of the wheel W can be subjected to rough polishing, and moreover, the surface of the wheel W can continuously be subjected to intermediate polishing and finish polishing.

After the polishing medium 720 is completely discharged below the wheel W, i.e., after the interior of the polishing medium receiving container 710 become empty, the polishing medium 720 is returned to the polishing medium receiving container 710 by using a suitable supply means (not shown). Thereafter, the wheel W is continuously subjected again to rough polishing, intermediate polishing and finish polishing. A practical extent attained by each polishing operation can be changed by adding pressurized air or water so as to allow the polishing medium 720 to be compressed by the pressurized air or water.

After the barrel polishing operation is completed, surface treatment such as coating, plating, alumite treatment or the like is conducted for the wheel W as is known in the art. All kinds of usually available surface treatment process is employable for carrying out the foregoing surface treatment.

According to the third embodiment of the present invention, since the feeding of the polishing medium to the surface of the work is attributable to the natural falling-down of the polishing medium, noisy sound is substantially reduced, and moreover, consumption of energy can be minimized.

In addition, according to the third embodiment of the present invention, since the guide sleeve is arranged between the feeding port of the polishing medium receiving container and the surface of the work, the feeding of the polishing medium to the work can be achieved without any loss.

Additionally, when the polishing medium received in the polishing medium receiving container can be compressed by using suitable means (not shown), a practical extent attained by each polishing operation performed for the work can be changed.

Figure 7:
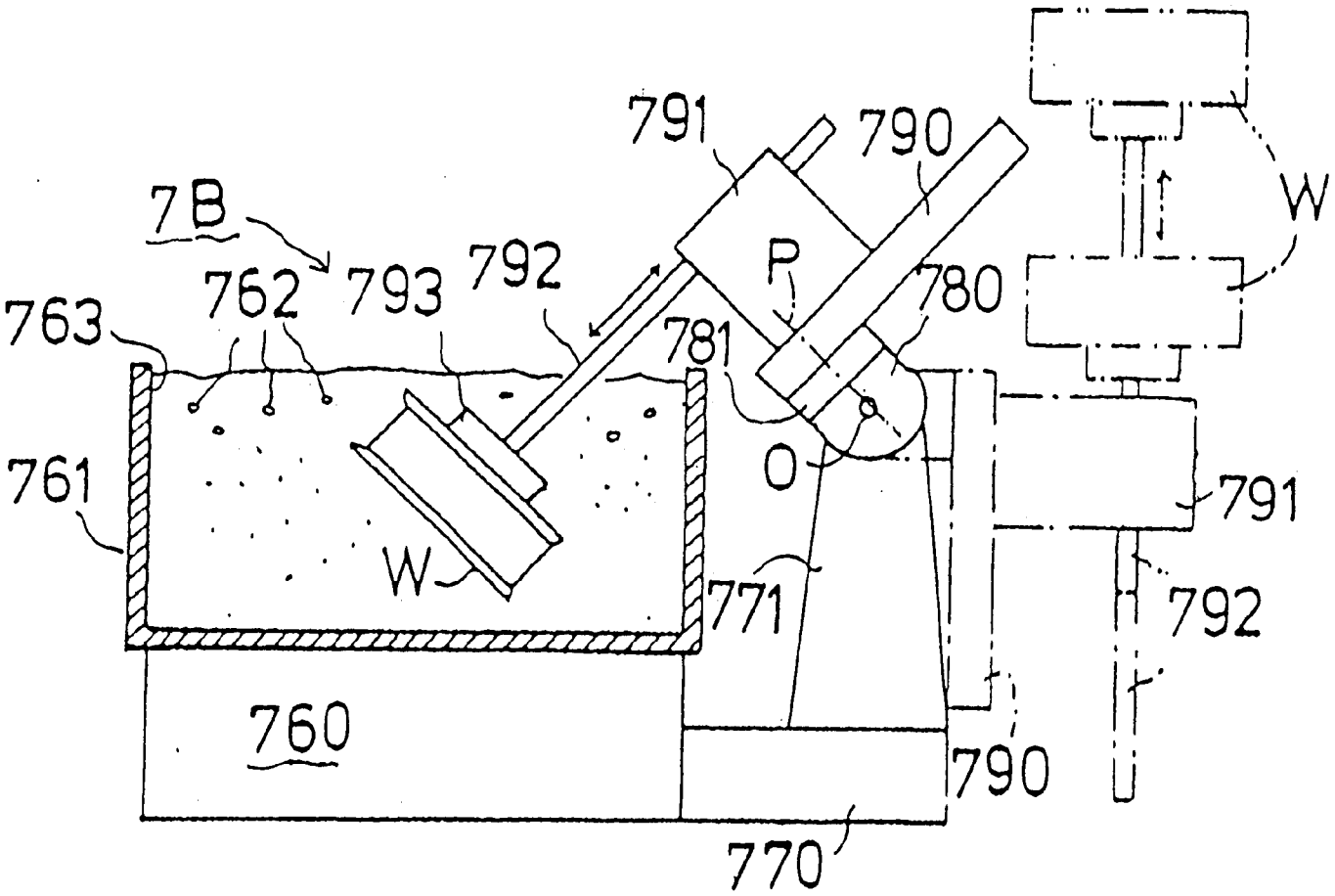
FIG. 7 is a sectional view showing a barrel polishing apparatus in the fourth embodiment of the present invention.

FIG. 7 shows a barrel polishing apparatus constructed in accordance with the fourth embodiment of the present invention.

In FIG. 7, reference numeral 7B designates a barrel polishing apparatus, and reference numeral 760 designates a driving section such as a motor for driving the barrel polishing apparatus 7B. Reference numeral 761 designates a cylindrical polishing medium receiving container mounted on the driving section 760. The polishing medium receiving container 761 can be rotated about an axis line of the driving section 760 in the circumferential direction by actuating the driving section 760. Reference numeral 762 designates a polishing medium in the polishing medium receiving container 761. All kinds of usually usable polishing medium such as ceramic grain or the like can be employed for the polishing medium 762. Incidentally, the polishing method can be practiced in accordance with a wet type polishing process or a dry type polishing process.

Reference numeral 763 designates an upper end opening which is formed at the upper end of the polishing medium receiving container 761, and the work W is dipped in the polishing medium 762 via the upper end opening 763.

Next, reference numeral 770 designates a base board which is integrated with the driving section 760, and reference numeral 771 designates a supporting column which upright stands on the base board 770. The supporting column 771 extends in the upward direction to reach the substantially upper end of the polishing medium receiving container 761.

Reference numeral 780 designates an attaching bracket which is arranged in such a manner as to swing on the supporting column 771. Specifically, the attaching bracket 780 can swing about a point O along the vertical surface. Reference numeral 790 designates a supporting bed mounted on the attaching bracket 780 via rotating means 781. Thus, the supporting bed 790 can swing along the vertical surface together with the attaching bracket 780, and moreover, the supporting bed 790 can turn or swing about an axis line P by driving the rotating means 781.

Reference numeral 791 designates a supporting member which is arranged on the supporting bed 790 so as to move in the forward/backward direction. In addition, reference numeral 792 designates a supporting arm which is fitted to the supporting member 791 so as to move in the forward/backward (longitudinal) direction relative to the supporting member 791. It should be noted that the forward/backward direction of the supporting arm 792 is coincident with the forward/backward direction of the supporting member 791. Reference character W designates a work (for example, an aluminum wheel usable for vehicle), and this work W is mounted on the foremost (distal) end of the supporting ram 792 via an air chuck 793, whereby the work W is dipped in the polishing medium 762 received in the polishing medium receiving container 761.

Next, an operation of the polishing apparatus constructed in the above-described manner will be described below.

Firstly, as shown by phantom lines (one-dot chain lines), the supporting arm 792 is mounted such that the foremost (distal) end of the supporting arm 792 is located directly above the supporting arm 792, and thereafter, the supporting arm 792 is retracted in the downward direction. While the foregoing state is maintained, the work W usable for a vehicle or the like is mounted on the foremost end of the supporting arm 792 by actuating the air chuck 793. Thereafter, as shown by phantom lines (two-dot chain lines), the supporting arm 792 is extended in the upward direction. Subsequently, as shown by solid lines, the supporting arm 792 is rotated about the point O together with the supporting bed 790 along the vertical surface so that the wheel W is dipped in the polishing medium 762 which is in the flowing state.

Incidentally, while the work W is dipped in the polishing medium 762, the supporting arm 792 can intermittently be displaced with the dipped state maintained. After completion of the polishing operation, the supporting arm 792 is rotated about the point O in the opposite direction together with the supporting member 791 and the supporting bed 790 along the vertical surface, the supporting arm 792 is in the upright state with the foremost end thereof located directly above the supporting member 791 as shown by the phantom lines (two-dot chain lines), and thereafter, the supporting arm 792 is displaced in the downward direction as shown by the phantom lines (one-dot chain lines). While the foregoing state is maintained, the wheel W is disconnected from the foremost end of the supporting arm 792. Subsequently, the aforementioned operational steps are repeated.

Incidentally, when soft material such as sponge, rubber, soft plastic or the like is used in the form of grain or small block as a polishing material usable for the polishing apparatus 78, each finish polishing operation can be performed at a high efficiency. Incidentally, soft material may be coated on the surface with hard grain or hard small block so as to allow it to be used as this kind of polishing medium.

After completion of the barrel polishing operation, surface treatment such as coating, plating, alumite treatment is carried out for the work W. All kind of normally employable surface treatment is involved in the concept of surface treatment as mentioned above.

The work W usable for practicing the third embodiment and the fourth embodiment of the present invention may be a work which is preliminarily subjected to surface treatment, and alternatively, it may be a work which is not subjected to any kind of surface treatment.

Figure 8B:
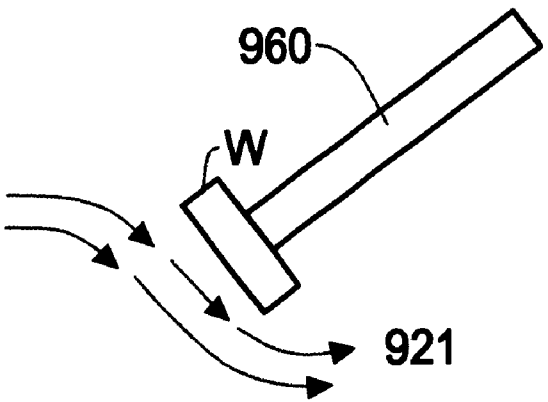
FIG. 8A and FIG. 8B are schematic diagrams showing the relationship between the flow of polishing medium and the position of the work in the present invention.
Figure 8A:
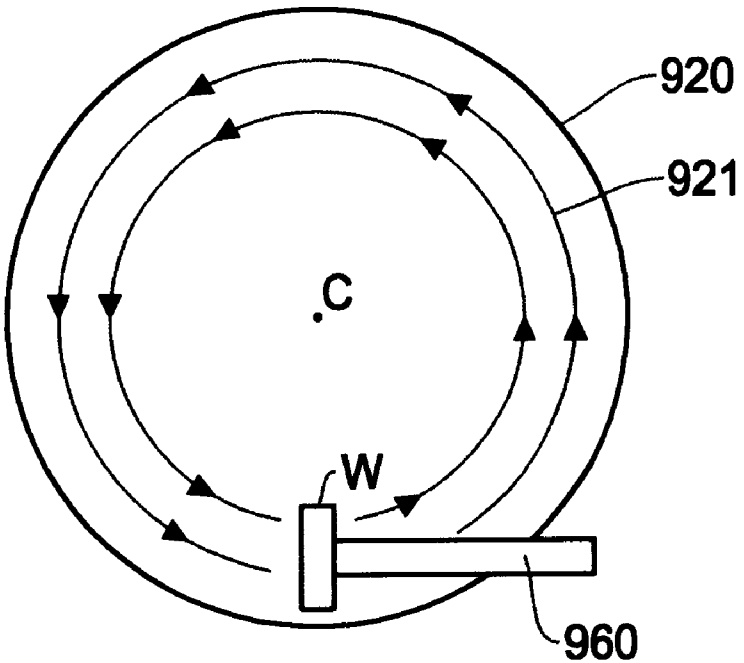

FIG. 8A and FIG. 8B are schematic diagrams showing the relationship between the flow of polishing medium and the position of the work in the present invention. In the present invention, as shown in FIG. 1, the work supporting arm 960 is positioned at an outer area within the polishing medium receiving container 920 but is apart from the center of the polishing medium receiving container 920. This relationship is more clearly shown in FIGS. 8A and 8B.

FIG. 8A is a top view showing the direction and position of the work supporting arm 960 in the polishing medium receiving container 920. The circular flow of the polishing medium 921 in the polishing medium receiving container 920 is shown by the arrows in FIG. 8A. The work supporting arm 960 is parallel with a line running through the center C of the polishing medium receiving container 920 but is apart from the center C and positioned at the outer area of the polishing medium receiving container 920. Namely, the work supporting arm 960 is positioned close to the inner wall of the container 920 as well as in the direction tangential to the container 920. The work W is attached to the tip (distal end) of the supporting arm 960 so that the work W receives a higher degree of friction by the flow of the polishing medium, resulting in the dramatic increase in the polishing efficiency.

FIG. 8B is a front view showing the angle of the work supporting arm 960, i.e., the work W, in the polishing medium receiving container 920. The work supporting arm 960 is diagonally introduced into the polishing medium receiving container 920 at the position as shown in FIG. 8A. Because of the angle of the work W in the polishing medium receiving container 920, the circumferential flow of the polishing medium 921 is forced to downwardly flow when striking the surface of the work W as shown by the arrows of FIG. 8B. This relationship causes the high degree of friction between the polishing medium 921 and the surface of the work W, thereby achieving the substantial increase in the polishing efficiency.

While the present invention has been described above with respect to preferred embodiments thereof, it should be noted that the present invention should not be limited only to these preferred embodiments but various changes or modifications may be made without departure from the scope of the present invention as defined by the appended claims.

What is claimed is:

1. A barrel polishing apparatus for polishing a surface of a work, comprising:

a polishing medium receiving container having a polishing medium therein;

means for rotating said medium container about a vertical axis for creating a continuous circumferential flow of said polishing medium therein; and a work supporting arm for attaching the work at a distal end thereof wherein the work supporting arm is rotatably connected to a supporting column provided outside of said polishing medium container, said work supporting arm being positioned away from a center of the polishing medium receiving container in a direction tangential to the polishing medium receiving container;

wherein said work supporting arm is inclined relative to a surface of the polishing medium so that the work is faced diagonally toward a direction of said continuous circumferential flow of polishing medium when polishing said work, thereby creating a downward flow of the polishing medium along a lower surface of the work.

* * * * *